United States Patent [19]

Landa et al.

[11] 4,286,039

[45] Aug. 25, 1981

[54] METHOD AND APPARATUS FOR REMOVING EXCESS DEVELOPING LIQUID FROM PHOTOCONDUCTIVE SURFACES

[75] Inventors: Benzion Landa, Edmonton, Canada; Ronald Swidler, Palo Alto; Kenneth W. Gardiner, Menlo Park, both of Calif.

[73] Assignee: Savin Corporation, Valhalla, N.Y.

[21] Appl. No.: 39,373

[22] Filed: May 15, 1979

[51] Int. Cl.[3] ..... G03G 15/10

[52] U.S. Cl. ..... 430/119; 118/661

[58] Field of Search ..... 427/15, 16, 17; 430/117, 118, 119; 118/651, 659–662; 355/10

[56] References Cited

U.S. PATENT DOCUMENTS

| | | | |
|---|---|---|---|
| 3,355,288 | 11/1967 | Matkan | 430/119 X |
| 3,663,219 | 5/1972 | Takahashi | 427/17 |
| 3,820,891 | 6/1974 | Kurakawa et al. | 118/662 X |
| 3,830,199 | 8/1974 | Saito et al. | 116/661 |
| 3,839,071 | 10/1974 | Borelli et al. | 427/16 |
| 3,905,331 | 9/1975 | Kimura et al. | 118/662 |
| 3,955,533 | 5/1976 | Smith et al. | 427/15 |

*Primary Examiner*—Morris Kaplan

*Attorney, Agent, or Firm*—Shenier & O'Connor

[57] ABSTRACT

A deformable polyurethane roller, which may be either a squeegee roller or a blotting roller, is positioned to contact a liquid-developed electrostatic image on a photoconductor. The polyurethane roller has a resistivity of $10^9$ ohm-centimeters or less and a Shore A hardness of 45 or less. The roller is biased by a potential having a sign the same as the sign of the charged toner particles in a liquid developer which comprises an insulating liquid having charged toner particles disseminated therethrough. The bias on the polyurethane roller is such that it prevents streaking, smearing, tailing or distortion of the developed electrostatic image and removes so much of the liquid carrier of the liquid developer from the surface of the photoconductor that the just-moist developed image can be transferred to a carrier sheet. This enables a higher-boiling insulating liquid to be used as the carrier liquid in a liquid developer. The polyurethane roller is driven so the relative motion between its surface and the surface of the photoconductor is substantially zero. In one form of the invention, the roller is a squeegee roller; in another form of the invention, the roller is a blotting roller formed with closed-cell polyurethane foam formed with open surface pores. Means are provided for squeezing liquid absorbed by the pores from the pores so as to continuously present open dry pores for blotting the liquid from the liquid-developed image.

After development, the developed image can be transferred to a carrier sheet, as is known to the art.

10 Claims, 3 Drawing Figures

METHOD AND APPARATUS FOR REMOVING EXCESS DEVELOPING LIQUID FROM PHOTOCONDUCTIVE SURFACES

BACKGROUND OF THE INVENTION

In electrophotography, a photoconductive surface is charged in the dark and then subjected to a light image of the document which is to be reproduced to form a latent electrostatic image corresponding to the original document. The latent electrostatic image thus formed can be developed by a dry developer powder which can be transferred to plain paper and then fused thereon by heat. This requires energy and entails the use of a higher voltage outlet than is normally found in offices. Because of the disadvantages of having to fuse a dry developed image, many electrophotographic copiers use liquid developers. These comprise an insulating liquid through which are disseminated toner particles. The photoconductor on which the developed image resides has been wetted by the liquid developer. The amount of liquid on the photoconductor can be reduced by a reverse roller such as shown in Hayashi et al U.S. Pat. No. 3,907,423. This reduces the quantity of liquid remaining on the photoconductive surface before the developed image is transferred to plain paper. The amount of liquid, however, is still such that liquid-developer machines frequently require a slight amount of heat to evaporate this residue of the liquid, which carries the toner particles, from the paper to which it has been transferred. Electrophotographic apparatus using a light hydrocarbon liquid as a carrier may be operated at a higher speed than if the carrier liquid were a higher-boiling hydrocarbon such as a light mineral oil. Evaporation of hydrocarbons in the atmosphere is disadvantageous if machines are operated for long periods of time in enclosed spaces. With a higher-boiling carrier liquid, if substantially all of the carrier liquid can be removed from the image, leaving it just moist enough so it can be transferred to a carrier sheet such as paper or the like, an electrophotographic machine employing a liquid developer would have many advantages.

It has been attempted to remove the excess liquid from the surface of the photoconductor after development of the image, both by a foam closed-cell elastomeric roller in which the open pores or pockets tend to blot up the liquid and by squeegeeing the excess liquid remaining on the photoconductive surface after the latent electrostatic image has been developed. Both of these disciplines, however, have resulted in streaking, tailing or blurring, so that the image becomes unsharp and unsatisfactory, and thus have failed to achieve their purpose.

1. Field of the Invention

Our invention relates to a method and apparatus for removing excess developing liquid from photoconductive surfaces, after a latent electrostatic image has been developed by a liquid developer, while producing sharp and pleasing reproductions of the original document which has been electrophotocopied.

2. Description of the Prior Art

Seanor et al U.S. Pat. No. 3,959,574 discloses a biasable polyurethane roller adapted to be positioned behind a carrier sheet to effect transfer of the developed latent electrostatic image from a photoconductive surface to paper. No suggestion of the use of this roller in any liquid-developer system is disclosed, nor is there any suggestion that the roller may be used to remove excess liquid from a liquid-developed electrostatic image.

Smith et al U.S. Pat. No. 3,955,533 shows a freely-rotatable polyurethane squeegee roller for removing excess developer liquid from a liquid-developed latent electrostatic image on a photoconductive drum. This system smears or blurs the image and possesses disadvantages which our invention overcomes.

Hayashi et al U.S. Pat. No. 3,907,423 discloses a reverse roller for metering the quantity of liquid remaining on the photoconductive surface after a latent electrostatic image has been developed. The reverse roller does not contact the photoconductive surface, and hence there remains a layer of liquid developer on the photoconductive surface, which it is the object of the instant invention to remove without distorting or blurring or disfiguring the developed image. While Hayashi et al disclose a biasing of the reverse roller, it is biased in the wrong direction and for the wrong purpose in respect of the instant invention. In Hayashi et al, the potential is biased so as to remove toner in the background areas, or non-image areas, from the surface of the photoconductor so that there will be no background or gray areas in the transferred image.

Buckley et al U.S. Pat. No. 3,863,603 discloses a roll carrying a conductive polyurethane coating which is intended for use in forming a magnetic brush in a dry developing process for latent electrostatic images.

Hudson U.S. Pat. No. 3,807,853 discloses the use of a closed-cell polyurethane foam formed with pores or pockets for cleaning a photoconductive surface of dry particles.

Matkan U.S. Pat. No. 3,752,119 discloses a squeegee roller for removing excess liquid from the photoconductive drum after a latent electrostatic image has been developed. Matkan shows nothing not shown by Smith et al.

Riley U.S. Pat. No. 3,656,200 discloses a sponge-like roller of polyurethane foam for cleaning the photoconductive drum after a liquid-developed electrostatic image has been transferred to a carrier sheet.

Hunstiger U.S. Pat. No. 3,384,051 relates to a method of moving a paper coated with a photoconductor through a liquid development bath and then squeegeeing the development liquid from the photoconductive surface of the paper after the image has been developed.

Matsumoto et al U.S. Pat. No. 3,368,526 is similar to Hunstiger in that it squeegees excess developing liquid from a flexible sheet bearing a developed electrostatic image.

SUMMARY OF THE INVENTION

In general, our invention contemplates the development of a latent electrostatic image with a liquid developer, removing the excess liquid by a reverse roller, and then either squeegeeing the remaining liquid from the developed electrostatic image or blotting the excess liquid from the electrostatic image, while simultaneously biasing the squeegee roller or the blotting roller with a potential like the potential of the toner particles which developed the latent electrostatic image. We have found that this bias remarkably prevents smearing or blurring of the developed image, even though the squeegee roller or the blotting roller is in contact with the image. Our arrangement is such that the image is left sufficiently moist so it can be transferred from the photoconductive surface to a carrier sheet such as paper or the like.

One object of our invention is to produce a novel method of removing excess developer liquid from a liquid-developed electrostatic image while on a photoconductive surface.

Another object of our invention is to provide a method of squeegeeing excess liquid from a liquid-developed electrostatic image, while on the photoconductor, without smearing or blurring the developed image.

Still another object of our invention is to provide a method of removing excess liquid from a liquid-developed electrostatic image by blotting the excess liquid from the developed image, while on the photoconductor, without smearing, streaking or blurring the developed image.

A further object of our invention is to provide a novel apparatus for removing excess liquid from a liquid-developed electrostatic image without blurring, streaking or deforming the image.

Other and further objects of our invention will appear from the following description.

BRIEF DESCRIPTION OF THE DRAWINGS

In the accompanying drawings, which form part of the instant specification and which are to be read in conjunction therewith, and in which like reference numerals are used to indicate like parts in the various views.

DESCRIPTION OF THE PREFERRED EMBODIMENT

Figures 1, 3:
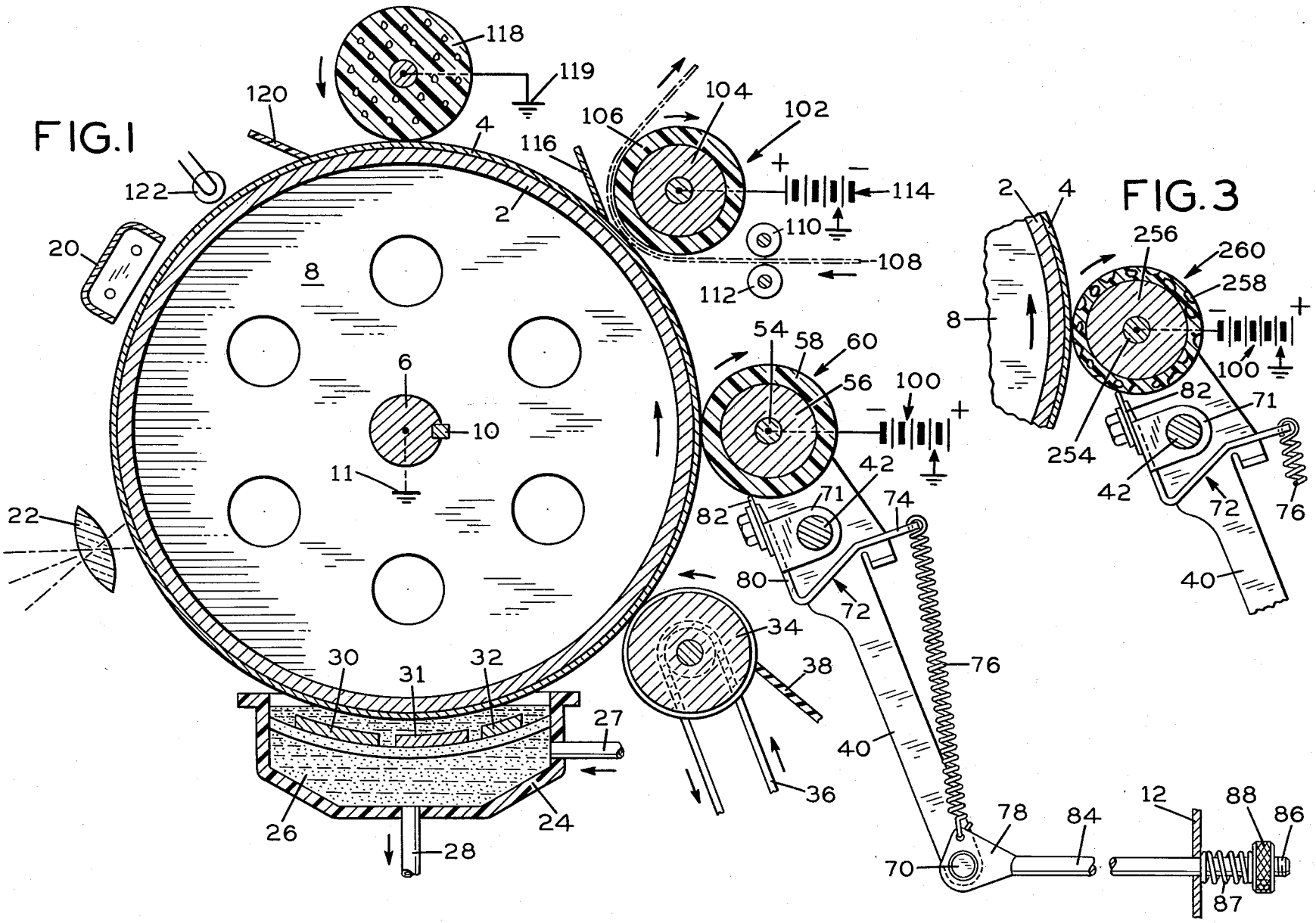
FIG. 1 is a diagrammatic view with parts in section, showing one form of apparatus capable of carrying out our invention, in which a squeegee roller is positioned between the reverse roller and the image-transfer roller.
FIG. 3 is a fragmentary view, showing a blotting roller instead of a squeegee roller.

More particularly, referring now to the drawings, a metal drum 2, carrying a layer of photoconductive material 4, is supported by discs 8 and keyed by key 10 to shaft 6 for rotation therewith, as can be seen by reference to FIG. 1.

Figure 2:
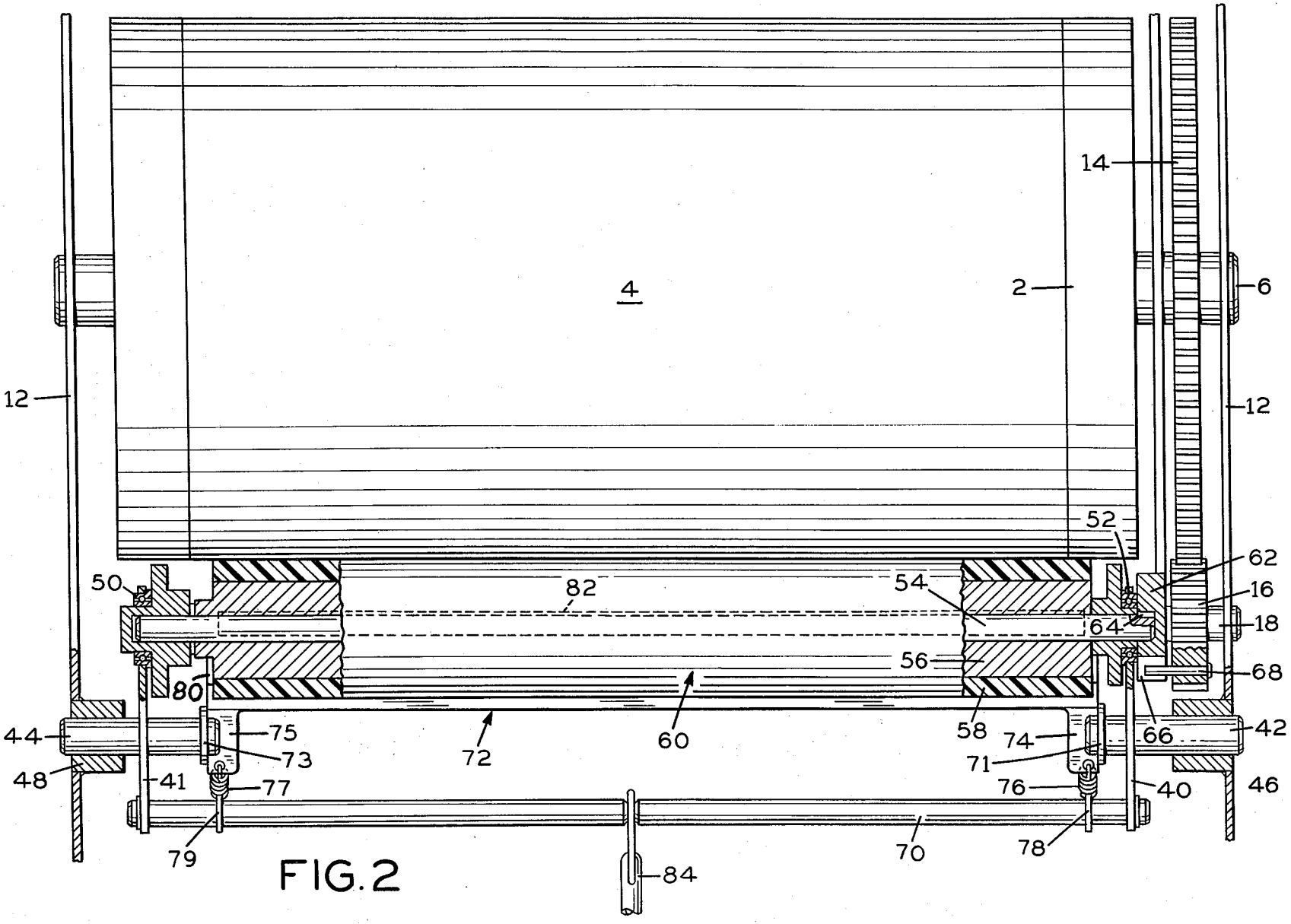
FIG. 2 is a top plan view with parts removed and parts in section, showing the relationship between the squeegee roller and the photoconductive drum.

Referring now to FIG. 2, the shaft 6 is journalled for rotation in bearings (not shown) carried by frame 12 of the housing of the electrophotographic apparatus, which is shown as a photocopying machine. A gear 14 is carried by the shaft 6 for rotation therewith. Gear 14 meshes with pinion 16, carried by shaft 18 which is also mounted in the frame 12 of the housing.

Referring again to FIG. 1, the drum 2 is driven by appropriate means (not shown) to rotate in a counterclockwise direction, as indicated by the arrow, past a corona 20 adapted to charge the photoconductive surface past a lens 22 which forms part of a station for exposing an image of the original document to be copied to form a latent electrostatic image on the photoconductor. A tank 24 is supplied with a liquid developer 26, introduced through a pipe 27 from a source (not shown) to which it is recirculated through a pipe 28 by a pump (not shown). The developing liquid comprises an insulating liquid carrier for toner particles which are pigmented charged particles. For purposes of illustration and not by way of limitation, the photoconductor 4 may be selenium which is charged positively by the corona discharge 20. The toner particles in the liquid developer are negatively charged so that they will be attracted to the latent electrostatic image which is formed of positively charged areas conforming to the original document being copied. Electrodes 30, 31 and 32 are part of an automatic-control biasing system for preventing the deposition of toner on non-image areas, shown in Schaefer et al U.S. Pat. No. 3,892,481. It is to be understood that any appropriate system for developing the latent electrostatic image with a liquid developer may be employed in our invention. After the latent electrostatic image has been developed at the developing station just described, it passes by a roller 34 driven in a counterclockwise direction—that is, so the adjacent surface of the photoconductor and the roller 34 will move in reverse directions. The reverse roller 34 is a metering or doctor roller adapted to limit the amount of liquid on the photoconductor after the latent image has been developed. It is driven by a flexible drive means 36 from any appropriate prime mover (not shown). A wiper 38 serves to keep the reverse roller dry. This reverse roller cannot touch the developed image, in order to prevent it from marring, blurring and distorting the image. A pair of members 40 and 41, shown in FIG. 2, are pivoted about a pair of stub shafts 42 and 44, carried in bearings 46 and 48, supported by the frame 12 of the housing of the machine. Member 40 carries bearings 50 and 52, in which a shaft 54 is rotatably carried. Secured to the shaft 54 is a metal core 56 which carries a layer 58 of resilient elastomeric polymeric material and, more particularly, conductive polyurethane. Seanor et al U.S. Pat. No. 3,959,574 discloses conductive polyurethanes having resistivities of between $3.1\times10^{14}$ to $1.7\times10^{8}$ ohm-centimeters. Buckley et al U.S. Pat. No. 3,863,603 discloses resilient polymeric material having a volume resistivity of $10^4$ ohm-centimeters.

It is important, in the instant invention, that the roller, indicated generally by the reference numeral 60 and comprising shaft 54, metal core 56, and conductive elastomeric covering 58, be such that the elastomer is deformable and have a resistivity no greater than $10^8$ ohm-centimeters. A Shore A hardness of between 25 and 45 is suitable for carrying out our invention. After the reverse roller has done its work, a layer of about ten to fifteen microns of developer liquid is left on the photoconductive drum. If the roller is made too hard, it does not squeegee the drum well.

A coupling member 62 is keyed by key 64 to the shaft 54. The coupling member is provided with a slot 66. A pin 68, carried by the pinion 16, extends into the slot 66 and constrains the coupling member 62 to rotate with the pinion, thus driving the roller 60. The members 40 and 41 carry a rod 70, extending across the machine therebetween.

Referring again to FIG. 1, pivoted about shaft 42 is a bell crank member 72, arm 74 of which is biased by spring 76, which extends from arm 74 to a member 78 carried by rod 70. As can be seen by reference to FIG. 2, a split arm 77, symmetrical with arm 76 and positioned on the opposite side of bell crank 72, is carried by the bell crank 72 and furnished with a spring 75 attached to a plate 79 carried by the rod 70.

Referring again to FIG. 1, the other arm 80 of bell crank member 72 carries a wiper blade 82 adapted to contact the squeegee roller 60. A rod 84 is connected to the rod 70 and extends through the frame 12 of the housing of the machine. The end 86 of the rod 84 is threaded and provided with a knurled adjusting nut 88.

The member 41 (shown in FIG. 2) is symmetrical with member 40. A spring 87 is positioned between the frame 12 of the housing and the adjusting nut 88. The adjusting nut places more or less compression on the spring 87 and thus controls the pressure with which the squeegee roller 60 contacts the surface of the photoconductive drum. It will be observed that the gear 14 and the pinion 16 ensure that the relative motion between the surface of the photoconductor and the surface of the squeegee roller 60 is zero, since the gear ratio is such as to ensure that there is no relative motion between these two elements.

In the prior art, as pointed out hereinabove, when it was attempted to squeegee the remaining liquid from a liquid-developed latent electrostatic image on a photoconductive surface, there was blurring, streaking and distortion, as well as removal of some of the toner from the image. The crux of our invention is the biasing of the roller, such that it creates a field holding the toner on the photoconductive surface. Since, with a selenium photoconductor, charged toner particles are negative, the bias applied to the squeegee roller is negative—that is, of the same polarity as the charge of the toner particles in the developing liquid. This ensures that the image remains fixed on the photoconductive surface without streaking, blurring or transfer to the squeegee roller. This remarkable result could not be anticipated until it was tried. The voltage applied to the squeegee roller is such that it is opposite in polarity and sufficiently high in potential so that the field created will ensure the fixing of the moist developed image on the photoconductor. It is to be understood, of course, that if the photoconductor is made of material which must be charged negatively, such as zinc oxide, the toner particles will be positively charged and the polarity will be reversed. If organic photoconductors such as Trinitrofluorenone-Polyvinyl Carbazole (TNF-PVCz) are used, they will be negatively charged and positively charged toner particles must be employed. Stated otherwise, the polarity of the charge on the squeegee roller 60 is the same as the polarity of the charged particles of the toner in the liquid developer and should be sufficiently high in potential to create a field holding the toner particles on the developed image even though the moist image is being squeegeed by the soft polyurethane squeegee roller. A Shore A hardness of over 45, though higher Shore A hardnesses still will produce the results of our invention, is not recommended. A harder-surfaced roller does not wipe the photoconductive drum as well as the deformable roller.

To ensure that the proper potential is impressed upon the squeegee roller 60, a source of potential such as a battery, indicated generally by the reference numeral 100, is impressed upon the core 56 carrying the conductive elastomer 58. We have shown this potential as variable to ensure that the proper results are obtained. If the voltage is too low, there will be tailing, streaking and displacement. As a matter of fact, we have observed that the image is intensified by being held onto the photoconductor. After the image has been dried without tailing, streaking or displacement, it is still moist, but the thin layer of liquid developer of between ten and fifteen microns in thickness has been squeegeed so as to leave a layer of only two to three microns in thickness. This small quantity of liquid is readily absorbed by the paper to which it is transferred, so the paper will feel dry to the touch.

The developed image, while still in a moist state, is now carried by the photoconductive layer 4 to the transfer station indicated generally by the reference numeral 102. A metal roller 104 carries a conductive polyurethane layer 106, similar to layer 58. Paper or other sheet material 108, to which the developed image is to be transferred, is fed by a pair of feeding rolls 110 and 112 to the nip between the layer 106 carried by the roller 104 and the photoconductive surface 4. Any appropriate means (not shown) for pressing the roller 104 against the drum is provided. This means may be similar to that which presses the roller 60 against the drum. Since it is now desired to transfer the developed image which is still in a moist state from the drum to the carrier sheet such as paper, a potential from any appropriate source of potential, which may be battery 114, is provided. In this case, the potential is opposite to that of the charge of the toner particles on the developed image. Since we have assumed the photoconductor is made of selenium and the toner particles are negatively charged, the potential applied to the transfer roller 104 will be positive. This will pull the image from the drum onto the paper. If desired, any means (not shown) may be employed for driving the roller 104 so that its surface has no relative motion with the surface of the photoconductor 4. It is understood, of course, that the pressure of the roller 104 against the drum is such that the paper will be drawn between the nip by the motion of the photoconductive drum. It is also understood that the metal drum 2 is grounded at 11, as shown in FIG. 1. A stripper blade 116 is provided to ensure that the paper or carrier sheet 108 leaves the roller. A scrubber roller 118, made of cellular polyurethane or the like, cleans any residual particles of toner which may not have been transferred from the drum. A wiper blade 120 completes the cleaning of the drum before it is discharged. The cleaning roller 118 may be made of conductive polyurethane and grounded at 119 to ensure that any residual charge on the drum is passed to ground. An incandescent lamp 122, placed adjacent the photoconductive layer 4, ensures that any residual charge on the photoconductor not removed by the grounded cleaning roller 108 is conducted to ground.

Referring now to FIG. 3, a blotting roller, indicated generally by the arrow 260, comprising a metal core 256 formed with a shaft 254, carries a coating of conductive open-cell polyurethane 258. In the form shown in FIG. 1, the roller 60 is a squeegee roller; in FIG. 3, the roller 260 is a blotting roller formed of a conductive foam closed-cell elastomeric material such as polyurethane. The roller is so formed that it presents open pores or pockets which fill up with liquid and can be displaced again by compressing the surface of the blotting roller. It will be observed that the roller 260 is analogous to roller 60, except that it blots or absorbs the developing liquid remaining on the surface of the photoconductor after it has passed the reverse doctor or metering roller 34. The coating 258 is more compressible than the coating 58 of the squeegee roller 60 and may be thinner, if desired, since the closed-cell foam composition has a higher resistivity. A blade 82 displaces the liquid from the open cells which have absorbed or trapped liquid inside of the open cells as they pass the developed image on the photoconductor. The blade 82 may be made of any suitable sheet material and has a small radius, more readily adapted to compress and remove liquid from the open pores of the blotting roller. In order to prevent the roller from removing any of the toner particles residing on the developed image from that image, the roller is biased by any appropriate source of potential, such as battery 100, in the same manner as the squeegee roller 60. Not only does this bias prevent the image from being distorted or removed from the surface of the photoconductor, but the reverse bias keeps the blotting roller 258 clean, so that only liquid which carries no charge, and no toner, moves to the pockets. It is to be observed that the blade 82, in the form shown in FIG. 3, does not wipe liquid from the blotting roller, but deforms it so as to squeeze liquid from the open pores. In the squeegee roller, the blade 82 is a wiper blade and wipes liquid from the smooth-surfaced squeegee roller.

It will be seen that we have accomplished the objects of our invention. We have provided a novel method of removing excess developer liquid from a liquid-developed electrostatic image while on a photoconductive surface, without smearing, blurring, streaking or deforming the image. In one embodiment of our invention, the excess liquid is squeegeed from the surface by a squeegee roller while the squeegee roller is biased to a polarity which is the same as the polarity of the toner particles and sufficiently high in potential to create a field holding the liquid-developed image strongly on the photoconductive surface, so that the squeegeeing operation will not smear, blur, streak or deform the developed image. In another embodiment of our invention, instead of squeegeeing the excess liquid from the surface of the photoconductor bearing the liquid-developed latent electrostatic image, we blot the excess liquid from the surface of the photoconductor by a roller presenting open cells and normally formed of a closed-cell polyurethane or other elastomeric foam which is sufficiently conductive so that it can be biased to hold the developed image on the photoconductor against the blotting action. We have shown apparatus capable of carrying out the method of our invention.

Owing to our method and apparatus, we are enabled to use higher-boiling carrier liquids such as light mineral oils. The amount of carrier liquid left on the photoconductor after the image has been developed is now, according to our invention, so small that the carrier liquid will be absorbed by the paper or other sheet material to which the image is transferred and need not be evaporated therefrom by heat or otherwise. This enables us to operate electrophotographic copying apparatus more rapidly and to use a liquid developer without polluting the atmosphere of an enclosed space in which an electrophotographic copying machine is continuously operated. The copies made by our method and apparatus are sharp and exhibit no blurring, streaking or deformation, as was the case when it was attempted to dry the surface of a photoconductor bearing a liquid-developed latent electrostatic image in the prior art.

We have achieved a new result which the prior art tried to accomplish but was unsuccessful. Because of the failure of the prior art, most of the present-day electrophotographic copying machines use dry developers which are fixed either by fusing by heat or by pressure rolls. The use of heat requires an inordinate quantity of energy and higher voltages. Pressure rolls, if marred or scratched, are extremely difficult and expensive to repair or replace. This operation cannot be done on location, but the machine must be removed. Furthermore, the spring rate of the pressure rolls varies with the temperature. On cold days, the rigidity of the spring may increase to such a point that drive gears or chains may slip or the drive motor may be torn loose from its moorings. In addition, the fixing of the magnetic toner by pressure rolls leaves a shiny surface which reflects light and which many find objectionable. Then too, if the copy is folded and refolded several times, the pressure-fixed image may become detached or flake off from the paper to which it has been transferred.

Our invention overcomes all of the disadvantages of the prior art and presents many advantages which were not thought possible of achievement.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. In a method of removing excess developing liquid from a photoconductive surface bearing an electrostatic image which has been developed by a liquid developer comprising an insulating liquid having charged toner particles disseminated therethrough, the improvement comprising contacting the photoconductive surface with a compressible conductive polyurethane roller having a Shore A hardness of less than 45 and a resistivity of less than $10^9$ ohm-centimeters, impressing the roller with a fixed potential relative to ground of the polarity corresponding to the polarity of the charge on the charged toner particles in the developing liquid, and rotating said roller so the relative motion between its surface and the surface of the photoconductor bearing the liquid-developed electrostatic image is substantially zero whereby to remove excess liquid from the surface of the photoconductor bearing the developed electrostatic image.

2. In a method of removing excess developing liquid from a photoconductive surface bearing an electrostatic image which has been developed by a liquid developer comprising an insulating liquid having charged toner particles disseminated therethrough, the improvement comprising blotting excess liquid from the surface of the photoconductor by a blotting roller formed of conductive foam closed-cell elastomeric material having a surface of a plurality of open pores while subjecting the blotting roller to the action of a fixed potential relative having a polarity of the same sign as the polarity of said toner particles and continuously compressing the surface of the blotting roller after its pores have absorbed liquid to remove the liquid therefrom whereby to present empty pores successively to the surface of the photoconductor while rotating said blotting roller so that the relative motion of its surface and the surface of the photoconductor with which it is in contact is substantially zero.

3. In an apparatus for removing excess developing liquid from a photoconductive surface in which a photoconductor bearing a latent electrostatic image is moved successively past a developing station where it is developed by a developing liquid comprising an insulating liquid having charged toner particles disseminated therethrough, a metering station for removing a portion of excess liquid from the surface of the photoconductor, and then to a transfer station where the developed image is transferred to a carrier sheet, the improvement comprising a conductive polyurethane roller positioned between the metering station and the transfer station in contact with the photoconductive surface, said polyurethane roller having a Shore A hardness of less than 45 and a resistivity of less than $10^9$ ohm-centimeters, a direct current voltage source fixed relative to ground for biasing said polyurethane roller with a polarity of the same sign as the charge polarity of said toner particles, and means for rotating said polyurethane roller so that the relative motion between its surface and the surface of the photoconductor bearing the developed electrostatic image is substantially zero.

4. Apparatus as in claim 3 in which said polyurethane roller is a squeegee roller.

5. Apparatus as in claim 3 in which said polyurethane roller is a blotting roller having open pores and means for removing liquid absorbed by said pores.

6. Apparatus as in claim 3 in which said polyurethane roller is a blotting roller having open pores.

7. In an apparatus for removing excess developing liquid from a photoconductive surface in which a photoconductor bearing a latent electrostatic image is moved successively past a developing station where it is developed by a developing liquid comprising an insulating liquid having charged toner particles disseminated therethrough, a metering station for removing a portion of excess liquid from the surface of the photoconductor, and then to a transfer station where the developed image is transferred to a carrier sheet, the improvement comprising a roller of conductive elastomeric material positioned between the metering station and the transfer station in contact with the photoconductive surface, said elastomeric roller having a Shore A hardness of less than 45 and a resistivity of less than $10^9$ ohm-centimeters, a direct current voltage source fixed relative to ground for biasing said elastomeric roller with a polarity of the same sign as the charge polarity of said toner particles, and means for rotating said elastomeric roller so that the relative motion between its surface and the surface of the photoconductor bearing the developed electrostatic image is substantially zero.

8. Apparatus as in claim 7 in which said elastomeric roller is a squeegee roller.

9. Apparatus as in claim 7 in which said elastomeric roller is a blotting roller having open pores and means for removing liquid absorbed by said pores.

10. Apparatus as in claim 7 in which said elastomeric roller is a blotting roller having open pores.

* * * * *

UNITED STATES PATENT AND TRADEMARK OFFICE

CERTIFICATE OF CORRECTION

PATENT NO. : 4,286,039

DATED : August 25, 1981

INVENTOR(S) : Benzion Landa, Ronald Swidler and Kenneth W. Gardiner

It is certified that error appears in the above-identified patent and that said Letters Patent are hereby corrected as shown below:

Column 8, line 49, after "relative" insert -- to ground --.

Signed and Sealed this

*Twenty-seventh* Day of *October 1981*

[SEAL]

*Attest:*

GERALD J. MOSSINGHOFF

*Attesting Officer*

*Commissioner of Patents and Trademarks*